US010264871B2

(12) United States Patent
Merzon

(10) Patent No.: US 10,264,871 B2
(45) Date of Patent: Apr. 23, 2019

(54) BACKPACK

(71) Applicant: Adam Merzon, Greenwich, CT (US)

(72) Inventor: Adam Merzon, Greenwich, CT (US)

( * ) Notice: Subject to any disclaimer, the term of this patent is extended or adjusted under 35 U.S.C. 154(b) by 75 days.

(21) Appl. No.: 15/586,510

(22) Filed: May 4, 2017

(65) Prior Publication Data

US 2017/0325574 A1 Nov. 16, 2017

Related U.S. Application Data

(60) Provisional application No. 62/334,498, filed on May 11, 2016.

(51) Int. Cl.
*A45F 3/00* (2006.01)
*A45F 3/04* (2006.01)

(52) U.S. Cl.
CPC ..... *A45F 3/047* (2013.01); *A45F 2003/003* (2013.01)

(58) Field of Classification Search
CPC ..... A45F 3/047; A45F 2003/003
USPC ..... 224/650
See application file for complete search history.

(56) References Cited

U.S. PATENT DOCUMENTS 5,779,036 A * 7/1998 Westbrook ..... A45F 3/04 190/102
5,826,771 A * 10/1998 Peng ..... A45F 3/04 224/651
6,712,250 B2 * 3/2004 Vigny ..... A45F 3/04 224/637
7,971,764 B2 * 7/2011 Sabbah ..... A45C 13/02 224/650
8,960,513 B2 * 2/2015 Crandall ..... A45F 3/04 224/576
2007/0017947 A1 * 1/2007 Fenton ..... A45C 7/0063 224/650
2009/0206118 A1 * 8/2009 Sabbah ..... A45C 13/02 224/652
2012/0031935 A1 * 2/2012 Cook ..... A45C 15/00 224/153
2017/0251781 A1 * 9/2017 Wilson ..... A45C 13/02

* cited by examiner

*Primary Examiner* — Peter N Helvey
(74) *Attorney, Agent, or Firm* — Jack Schwartz & Associates, PLLC

(57) ABSTRACT

A device for storing and carrying items. The device includes a storage section. A binder holder is connected to and extends from a front wall of the storage section. The binder holder includes first and section connection arms extending from the binder holder on a side opposite the connection to the front wall. The first and second connection arms extend in opposite directions from the binder holder. A first connector extends from a first side wall of the storage section for mating with the first connection arm. A second connector extends from a second side wall of the storage section for mating with the second connection arm. When the first connector mates with the first connection arm and the second connector mates with the second connection arm, the binder holder forms a pouch with the front wall for selectively receiving an item therein.

10 Claims, 3 Drawing Sheets

BACKPACK

BACKGROUND OF THE INVENTION

Field of the Invention

The present invention relates to an apparatus for storing and carrying items and, more specifically, to a backpack able to retain items against an outer side thereof.

Description of the Prior Art

Backpacks have been used for many years for many different purposes. Generally, backpacks are a convenient and non-obtrusive way to carry items from place to place. Backpacks are used by students to carry their books, notebooks, school supplies and electronic devices to, from and around school. Backpacks are also used by travelers to carry personal items and documents needed for travel to different places. As the use of backpacks has increased and people attempt to carry more items with them wherever they go, backpacks either need to become larger or include more creative ways for storing items.

SUMMARY OF THE PRESENT INVENTION

An apparatus is provided for selectively and releasably securing an item within an area on an outside of a backpack.

A device for storing and carrying items is provided. The device includes a storage section. A binder holder is connected to and extends from a front wall of the storage section. The binder holder includes first and second connection arms extending from the binder holder on a side opposite the connection to the front wall. The first and second connection arms extend in opposite directions from the binder holder. A first connector extends from a first side wall of the storage section for mating with the first connection arm. A second connector extends from a second side wall of the storage section for mating with the second connection arm. When the first connector mates with the first connection arm and the second connector mates with the second connection arm, the binder holder forms a pouch with the front wall for selectively receiving an item therein.

The device further includes a cover extending from a back wall of the storage section, the cover being movable between a first position providing access to the storage section and a second position restricting access to the storage section and covering the pouch formed by the binder holder and front wall. The item being retained within the pouch may be a binder. The cover includes a connection device on a side opposite the connection to the back wall for releasably securing the cover in the second position. In the second position, the cover extends over and secures the binder in the pouch when the binder is positioned in the pouch.

The device further includes a pocket positioned in the first wall and the binder holder is connected within the pocket. The binder holder is movable between a first position stored within the pocket and a second position extending from the pocket. A closing mechanism selectively closes the pocket securing the binder holder therein when in the first position. The first and second connection arms extend upward and at an angle from the binder holder. The storage section includes a device for selectively restricting access to the storage section. A length of the first and second connection arms is adjustable enabling adjustment of a size of the pouch formed by the binder holder and first side.

The storage section includes a device for selectively restricting access to an inside of the storage section. The device further includes shoulder straps extending from the back wall thereof. The shoulder straps have an adjustable length.

BRIEF DESCRIPTION OF THE DRAWING FIGURES

In order that the invention may be more fully understood, it will now be described, by way of example, with reference to the accompanying drawings in which.

DETAILED DESCRIPTION OF THE PREFERRED EMBODIMENT

Figure 1A:
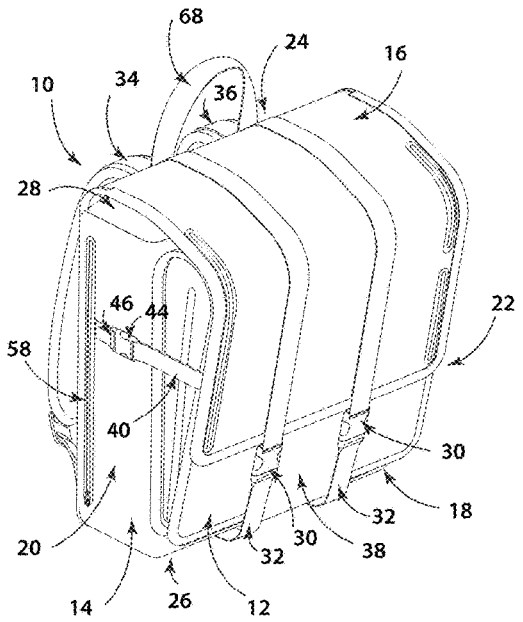
FIG. 1A is a front perspective view of a backpack according to invention principles including a binder releasably secured to an outer side thereof.
Figure 1B:
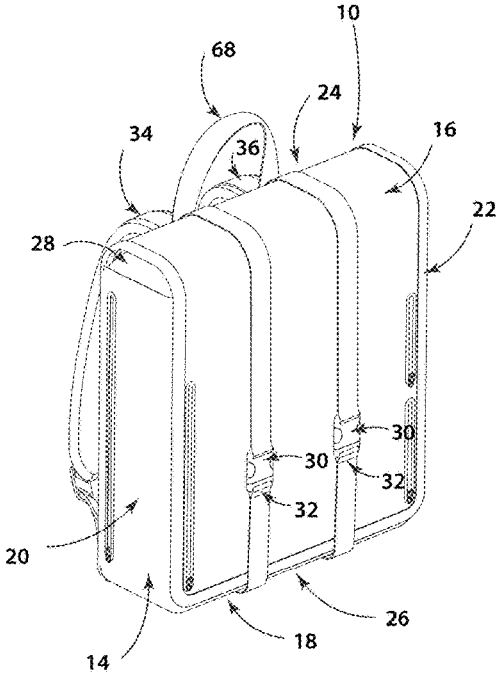
FIG. 1B is a front perspective view of a backpack according to invention principles.

The following discussion describes this device and system. This discussion should not be construed, however, as limiting to any particular embodiment. Practitioners skilled in the art will recognize numerous other embodiments as well.

Turning now to the drawings, FIGS. 1-8 illustrate a backpack 10. FIGS. 1A and 1B show front perspective views of the backpack 10. FIG. 1A shows the backpack 10 having a cover 16 releasably secured in a closed position restricting access to a central section 14 forming a storage section or compartment 28 and a binder 12 retained against an outer side of the storage compartment 28. FIG. 1B shows the backpack 10 having the cover 16 releasably secured in a closed position restricting access to the storage compartment 28 without the binder 12 retained against the outer side of the storage compartment 28. The backpack 10 includes the central section 14 and the cover 16. The central section 14 includes a front wall 18, a left side wall 20, a right side wall 22, a back wall 24, and a base 26. The front, left, right and back walls, 18, 20, 22 and 24, respectively, are connected together and extend perpendicularly from the base 26 to form the storage compartment 28. The backpack 10 is preferably made of a durable and flexible material allowing the storage compartment 28 to receive items of any shape and conform to fit multiple items therein.

The cover 16 extends from the back wall 24. The cover 16 is movable between a first open position and a second closed position extending over an open side of the storage compartment 28, selectively restricting access to the storage compartment 28. At an end of the cover 16 opposite the connection to the back wall 24 is a connection device 30. A connector 32 for mating with the connection device 30 extends from one of the front wall 18 or base 26. When the connection device 30 mates with the connector 32, the cover 16 is releasably secured in the second closed position to cover and restrict access to the storage compartment 28. The connection device 30 and connector 32 are shown as a clip fastener device. However, any device able to releasably secure the cover 16 in place covering and restricting access to the storage compartment 28 may be used. Additionally, the connection device 30 and connector 32 may have an adjustable length allowing the cover 16 to adjust to the level at which the storage compartment 28 is filled as well as to accommodate items placed between the front wall 18 and an underside of the cover 16. Extending from the back wall 24 are first and second shoulder straps 34 and 36. The shoulder straps 34, 36 are adjustable for receiving the arms of a user and to retain the backpack 10 on their back. An additional loop 68 may be provided extending between the first and second shoulder straps 34, 36 for grabbing and carrying the backpack 10 by hand or releasably retaining the backpack on a hook.

A binder holder 38 is connected to the backpack and may extend out from the front wall 18. The binder holder 38 includes a left arm 40 and a right arm 42 (not shown in FIG. 1A) extending from respective sides of the binder holder 38 opposite the connection to the backpack 10. At an end of the left arm 40 is a second connection device 44. A corresponding second connector 46 extends from the left wall 20 for mating with the second connection device 44. A similar second connection device 48 extends from the right arm 42 for mating with a corresponding second connector 50 extending from the right wall 22. The second connection devices 44, 48 and second connectors 46, 50 are shown as clip fastener devices. However, any device able to releasably secure the binder holder 38 to the left and right walls 20, 22 of the backpack 10 may be used. Additionally, the second connection devices 44, 48 and second connectors 46, 50 may have an adjustable length enabling items of various thicknesses to be snugly accommodated between the binder holder 38 and the front wall 18 of the backpack 10. The binder holder 38 is preferably made of a flexible material enabling the binder holder 38 to conform to the shape of an item or items placed therein and to accommodate items of varying shapes.

Figure 2:
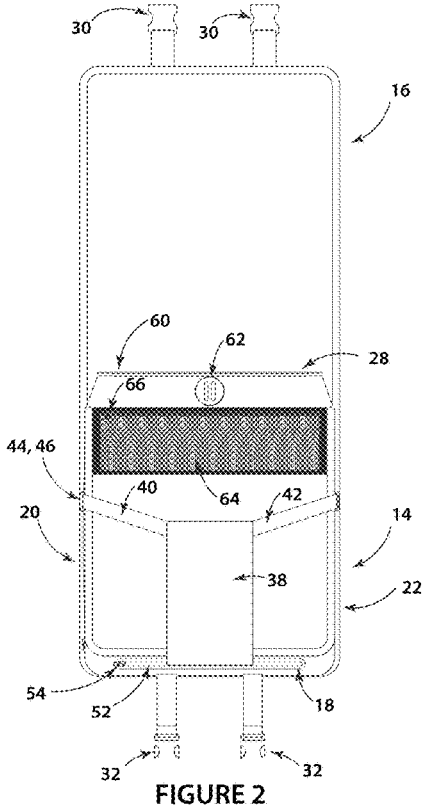
FIG. 2 is a front view of a backpack according to invention principles having the front cover in an open position.

FIG. 2 shows the backpack 10 with the cover 16 in an open position exposing the storage compartment 28. The storage compartment 28 is provided for retaining items to be carried in the backpack 10. Access to the storage compartment 28 is provided when the cover 16 is in the first open position. The storage compartment 28 may include a pull string 60 connected around an opening to the storage compartment 28. The pull string 60 may be inserted in a seam sewn around the opening in the storage container 28, each end of the pull string 60 exiting the seam through a pair of button holes 62. When the ends of the pull string 60 are pulled and tied or secured together, the opening to the storage compartment 28 may be closed or restricted thereby providing further security for items positioned within the storage compartment 28. The pull string 60 is one method of selectively closing the opening in the storage compartment 28. However, any device able to selectively close the opening in the storage compartment 28 may be used.

At a base on the front wall 16 is an opening 52. The opening 52 provides access to a pocket in the front side 18. At the opening 52 may be positioned a zipper 54 or any other closure device for selectively closing the opening 52 and restricting access to the pocket. The binder holder 38 may be secured at one end within the pocket. When not in use, the binder holder 38 may be retained within the pocket and thus hidden from view. The binder holder 38 may be secured within the pocket by closing the zipper 54. When in use, the binder holder 38 is removed from the pocket so as to extend therefrom. The binder holder 38 includes the left arm 40 and right arm 42 extending therefrom at an end opposite the connection within the pocket. The left and right arms 40, 42 preferably extend at an upwards angle and in opposing directions from the binder holder 38. Connected to an end of the left arm 40 is the second connection device 44 and extending from the left side wall 20 of the backpack 10 is the second mating connector 46. The second connection device 48 is connected to the right arm 42 of the binder holder 38 and the corresponding second mating connector 50 extends from the right side wall 22. The second mating connectors 46, 50 may preferably extend from the left and right walls 20, 22, respectively, at a downwards angle towards the left and right arms 40, 42. The second connection devices 44, 48 extend from the sides of the binder holder 38 and, when mated with the second mating connectors 46, 50, releasably secure the binder holder 38 in place to form a pocket between the binder holder 38 and the front wall 18. The pocket is able to receive and retain an item such as the binder 12. The binder 12 may be positioned within the pocket between the front wall 18 of the backpack 10 and the binder holder 38. Once the binder 12 is positioned within the pocket, a length of the left and right side arms may be adjusted to further secure the binder 12 within the pocket. The cover 16 may be positioned to extend over the binder 12 and binder cover 38 to cover the pocket and further secure the binder 12 in place. A further pocket 64 may be positioned on the front wall 18 to provide additional storage. The further pocket 64 may be selectively closed by a zipper or other closure device 66. FIG. 2 shows a single pocket 64. However, any number of pockets of any size able to fit on the front wall 18 may be positioned thereon.

Figure 3:
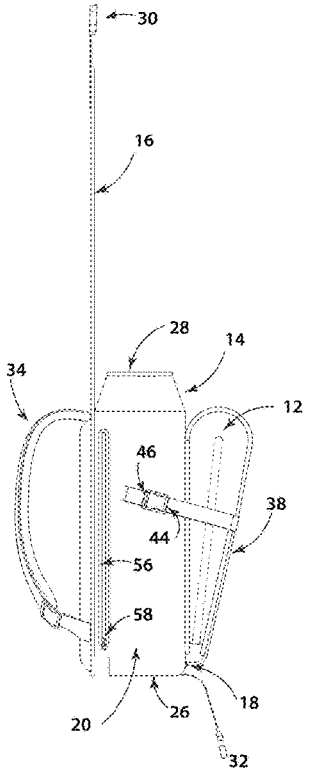
FIG. 3 is a right side view of a backpack according to invention principles having the front cover in an open position.
Figure 4:
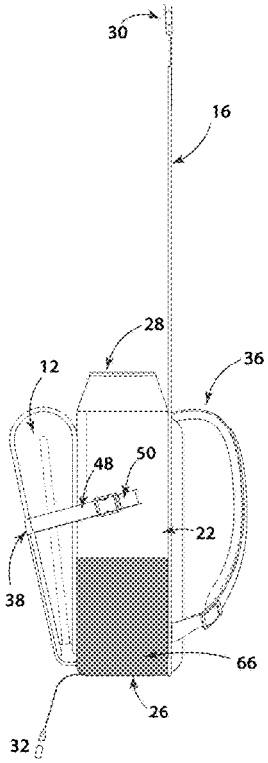
FIG. 4 is a left side view of a backpack according to invention principles having the front cover in an open position.

FIG. 3 shows a left side view and FIG. 4 shows a right side view of the backpack 10 including the cover 16 in an open position and the binder 12 releasably secured in the pocket between the front wall 18 and the binder holder 38. As can be seen in FIG. 3, the second mating connector 46 extends from the left wall 20 for engaging with the second connection device 44. Positioned in the pocket between the front wall 18 and the binder holder 38 is the binder 12. The binder 12 is secured in position between the front wall 18 and binder holder 38 when the second connection device 44 and second mating connector 46 on the left side of the backpack 10 are engaged and when the second connection device 48 and second mating connector 50 on the right side of the backpack 10 are engaged as shown in FIG. 4. The second connection devices 44, 48 and second mating connectors 46, 50 may be adjustable in length enabling the size of the pocket between the binder holder 38 and front wall 18 to be adjusted to create a snug fit with any item positioned therein. A pocket 56 providing additional storage may be positioned on either the left or right side 20, 22. An opening provides access to a pocket 56, shown in the left wall 18 of FIG. 3 for additional storage. At the opening of the pocket 56 may be positioned a zipper 58 or any other closure device for selectively closing and restricting access to the pocket 56. A pouch 66 is shown on the right wall 22 in FIG. 4. The pouch 66 may be provided for receiving an item such as a water bottle. The pouch 66 is shown on the right wall 22 for purposes of example but the pouch may be positioned on any other wall or walls of the backpack 10.

Figure 5:
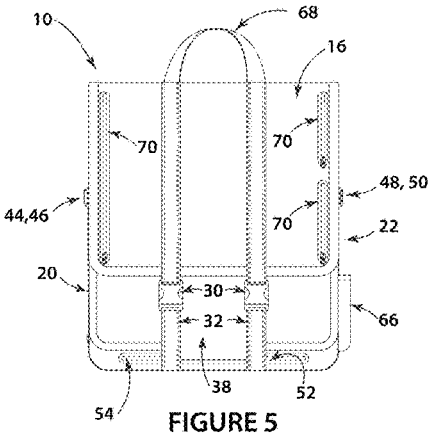
FIG. 5 is a front view of a backpack according to invention principles having the front cover in a closed position.

FIG. 5 shows the backpack 10 with the cover 16 in a closed position restricting access to the storage compartment 28. At a base on the front wall 16 is the opening 52. The opening 52 provides access to a pocket in the front side 18. At the opening 52 may be positioned a zipper 54 or any other closure device for selectively closing the opening 52 and restricting access to the pocket. The binder holder 38 may be secured at one end within the pocket. When not in use, the binder holder 38 may be retained within the pocket and thus hidden from view. The binder holder 38 may be secured within the pocket by closing the zipper 54. When in use, the binder holder 38 may be removed from the pocket so as to extend therefrom. Connected to an end of the left arm 40 extending from the binder holder 38 is the second connection device 44 and extending from the left side wall 20 of the backpack 10 is the second mating connector 46. The second connection device 48 is connected to the right arm 42 extending from the binder holder 38 and extending from the right side wall 22 of the backpack 10 is the second mating connector 50. The second connection devices 44, 48 extending from the sides of the binder holder 38 releasably secure the binder holder 38 in place when mated with the second mating connectors 46, 50. A binder 12 or other item may be positioned in the pocket formed between the front wall 18 of the backpack 10 and the binder holder 38. The second connection devices 44, 48 and second connectors 46, 50 are engaged to releasably secure the binder 12 in position. Additional pockets 70 may be positioned on the cover 16 to provide additional storage for the backpack 10.

Figure 6:
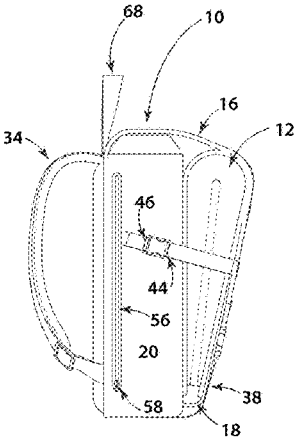
FIG. 6 is a right side view of a backpack according to invention principles having the front cover in a closed position.
Figure 7:
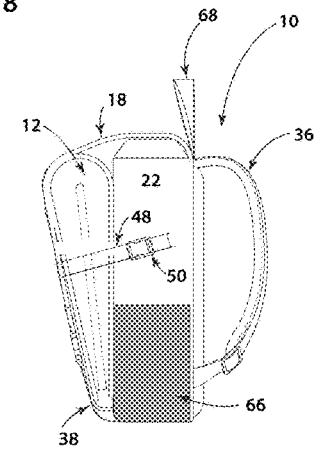
FIG. 7 is a left side view of a backpack according to invention principles having the front cover in a closed position.

FIG. 6 shows a left side view and FIG. 7 shows a right side view of the backpack 10 including the cover 16 in a closed position and the binder 12 secured between the front wall 18 and the binder holder 38. As can be seen in FIG. 6, the second mating connector 46 extends from the left wall 20 for engaging with the second connection device 44. Positioned between the front wall 18 and the binder holder 38 may be a binder 12. The binder 12 may be secured in position between the front wall 18 and binder holder 38 when the second connection device 44 and second mating connector 46 on the left side of the backpack 10 are engaged and when the second connection device 48 and second mating connector 50 on the right side of the backpack 10 are engaged as shown in FIG. 7. A length of the right arm and left arm may be adjusted to provide a more secure fit for the binder 12 within the pocket. A pocket providing further storage space may be provided on the left wall 20 as shown in FIG. 7. An opening provides access to the pocket 56 in the left wall 18. At the opening to the pocket 56 may be positioned a zipper 58 or any other closure device for selectively closing the pocket 56 and restricting access thereto. A pouch 66 is shown on the right wall 22 in FIG. 7. The pouch 66 may be provided for receiving an item such as a water bottle. The pouch 66 is shown on the right wall 22 for purposes of example but the pouch may be positioned on any other wall or walls of the backpack 10.

Figure 8:
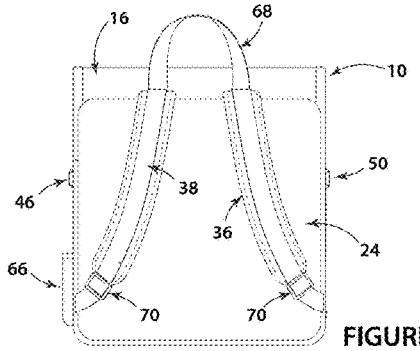
FIG. 8 is a back side view of a backpack according to invention principles having the front cover in a closed position.

FIG. 8 shows a back wall 24 of the backpack 10. The shoulder traps 34, 36 extend from the back wall 24. Each of the shoulder straps 34, 36 include a buckle 70 for adjusting the length of the shoulder straps to fit a user of the backpack 10. Also shown is additional loop 68 extending between the first and second shoulder straps 34, 36 for grabbing and carrying the backpack 10 by hand or releasably retaining the backpack on a hook.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist according to invention principles that others can, by applying current knowledge, readily adapt it for various applications without omitting features that, from the standpoint of prior art, fairly constitute essential characteristics of the generic aspects of this invention.

The invention claimed is:

1. A device for storing and carrying items, said device comprising:

a storage section;

a pocket positioned in a front wall of the storage section;

a binder holder connected within the pocket, said binder holder including first and second connection arms extending from the binder holder on a side opposite the connection within the pocket, said first and second connection arms extending from the binder holder in opposite directions, the binder holder being movable between a first position stored within the pocket and a second position extending from the pocket;

a first connector positioned on a first side wall of the storage section for mating with the first connection arm;

a second connector positioned on a second side wall of the storage section for mating with the second connection arm, when said first connector mates with the first connection arm and the second connector mates with the second connection arm, the binder holder forms a pouch with the front wall for selectively receiving an item therein; and a cover extending from a back wall of the storage section, the cover being movable between a first position providing access to the storage section and a second position restricting access to the storage section and covering the pouch formed between the binder holder and front wall and any item received within the pouch.

2. The device of claim 1, wherein a binder is selectively received in the pouch.

3. The device of claim 1, wherein, the cover includes a connection device on a side opposite a connection to the back wall for releasably securing the cover in the second position.

4. The device of claim 1, further comprising a closing mechanism for selectively closing the pocket to secure the binder holder in the pocket when in the first position.

5. The device of claim 1, wherein the first and second connection arms extend upward and at an angle from the binder holder.

6. The device of claim 1 wherein the storage section includes a device for selectively restricting access to the storage section.

7. The device of claim 1, wherein a length of the first and second connection arms is adjustable enabling adjustment of a size of the pouch formed between the binder holder and first side.

8. The device of claim 1, further comprising shoulder straps extending from the back wall of the storage section.

9. The device of claim 8, wherein a length of the shoulder straps is adjustable.

10. The device of claim 1, wherein the binder holder is formed from a flexible material.

* * * * *